US009564019B2

(12) United States Patent
Gupta et al.

(10) Patent No.: US 9,564,019 B2
(45) Date of Patent: Feb. 7, 2017

(54) COMPUTERIZED BINGO-TYPE GAME USING BINGO SYMBOLS DRAWN FROM SYMBOL GROUPS

(71) Applicant: GSN Games, Inc., San Francisco, CA (US)

(72) Inventors: Sumit Gupta, Fremont, CA (US); Vikas Gupta, San Francisco, CA (US)

(73) Assignee: GSN Games, Inc., San Francisco, CA (US)

( * ) Notice: Subject to any disclaimer, the term of this patent is extended or adjusted under 35 U.S.C. 154(b) by 168 days.

(21) Appl. No.: 14/083,881

(22) Filed: Nov. 19, 2013

(65) Prior Publication Data

US 2015/0141110 A1 May 21, 2015

(51) Int. Cl.

| | |
|---|---|
| ***A63F 9/24*** | (2006.01) |
| ***G07F 17/32*** | (2006.01) |
| ***A63F 3/06*** | (2006.01) |

(52) U.S. Cl.

CPC ..... *G07F 17/3286* (2013.01); *A63F 3/06* (2013.01); *A63F 3/062* (2013.01); *A63F 3/0645* (2013.01); *G07F 17/326* (2013.01); *G07F 17/329* (2013.01); *G07F 17/3258* (2013.01); *G07F 17/3262* (2013.01)

(58) Field of Classification Search

CPC ..... A63F 3/06; A63F 3/062; A63F 3/0645; A63F 13/00; G07F 17/32; G07F 17/3258; G07F 17/3262; G07F 17/34

See application file for complete search history.

(56) References Cited

U.S. PATENT DOCUMENTS

| | | | | |
|---|---|---|---|---|
| 2,574,058 | A | 11/1951 | Porter | |
| 2,724,392 | A | 11/1955 | Cooper | |
| 2,896,648 | A | 7/1959 | Lazarus | |
| 3,428,060 | A | 2/1969 | Spivey | |
| 4,401,476 | A | 8/1983 | Klaiber | |
| 4,448,209 | A | 5/1984 | Lindsay | |
| 4,560,171 | A | 12/1985 | Anthony | |
| 5,186,193 | A | 2/1993 | Gullberg et al. | |
| 5,291,827 | A | 3/1994 | Liers et al. | |
| 5,482,289 | A * | 1/1996 | Weingardt | A63F 3/0645 273/269 |
| 5,490,460 | A | 2/1996 | Soble et al. | |
| 5,614,027 | A | 3/1997 | Dunn et al. | |
| 5,636,571 | A | 6/1997 | Abrahamson | |

(Continued)

*Primary Examiner* — Lawrence Galka

(74) *Attorney, Agent, or Firm* — Knobbe, Martens, Olson & Bear, LLP

(57) ABSTRACT

A system for allowing players to play a bingo-type game with a user computing device is described herein. The system includes a database including a plurality of bingo symbols and a system controller coupled to the database. The system controller is configured to receive a request from a player to play the bingo-type game and responsively display the bingo-type game on the at least one user computing device. The system controller is configured to determine a plurality of symbol groups included in the bingo-type game, randomly select a set of bingo symbols, and displays the selected set of bingo symbols with respect to the symbol grid. Each symbol group includes a predefined set of bingo symbols. The set of bingo symbols including a bingo symbol selected from each one of the symbol groups. Each bingo symbol in the set of bingo symbols is displayed simultaneously.

6 Claims, 13 Drawing Sheets

(56) References Cited

U.S. PATENT DOCUMENTS

| | | | |
|---|---|---|---|
| 5,674,827 | A | 10/1997 | Kawashima et al. |
| 5,935,002 | A | 8/1999 | Falciglia |
| 6,044,852 | A | 4/2000 | Epperson, Jr. et al. |
| 6,079,711 | A | 6/2000 | Wei et al. |
| 6,409,173 | B1 | 6/2002 | Tri |
| 6,656,044 | B1 | 12/2003 | Lewis |
| 6,668,844 | B2 | 12/2003 | Bergman et al. |
| 6,821,355 | B1 | 11/2004 | Taylor et al. |
| 7,837,550 | B2 | 11/2010 | Odom |
| 8,123,607 | B2 | 2/2012 | Van Asdale |
| 8,201,827 | B2 | 6/2012 | Weingardt |
| 8,387,985 | B1 | 3/2013 | Itkis et al. |
| 8,602,864 | B1 | 12/2013 | Lewis |
| 2002/0017209 | A1 | 2/2002 | Gutfleisch et al. |
| 2002/0083958 | A1 | 7/2002 | Bran |
| 2003/0010363 | A1 | 1/2003 | Cotte et al. |
| 2003/0062067 | A1 | 4/2003 | Meyer et al. |
| 2003/0062071 | A1 | 4/2003 | Sorbo et al. |
| 2003/0064772 | A1 | 4/2003 | Tempest et al. |
| 2003/0125101 | A1 | 7/2003 | Campo |
| 2004/0242313 | A1* | 12/2004 | Munoz ..... G07F 17/3262 463/20 |
| 2005/0059470 | A1 | 3/2005 | Cannon |
| 2005/0059471 | A1 | 3/2005 | Cannon |
| 2005/0101387 | A1 | 5/2005 | Wolf |
| 2005/0119042 | A1 | 6/2005 | Chamberlain et al. |
| 2006/0035699 | A1* | 2/2006 | Falciglia, Sr. ..... G07F 17/32 463/19 |
| 2006/0052160 | A1* | 3/2006 | Saffari ..... G07F 17/3258 463/27 |
| 2006/0079309 | A1 | 4/2006 | Walker et al. |
| 2006/0121977 | A1 | 6/2006 | Odom |
| 2006/0252493 | A1 | 11/2006 | Tribout |
| 2007/0060333 | A1 | 3/2007 | Englman et al. |
| 2009/0247258 | A1* | 10/2009 | Anderson ..... G07F 17/34 463/18 |
| 2012/0009987 | A1 | 1/2012 | Dumont et al. |
| 2014/0018143 | A1 | 1/2014 | Yarbrough |
| 2014/0274280 | A1 | 9/2014 | Macbeth et al. |
| 2015/0038211 | A1 | 2/2015 | Santosh et al. |
| 2015/0141111 | A1 | 5/2015 | Gupta et al. |

* cited by examiner

COMPUTERIZED BINGO-TYPE GAME USING BINGO SYMBOLS DRAWN FROM SYMBOL GROUPS

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to a system for allowing players to play matching games and more particularly, to methods and systems for allowing players to play bingo-type games that simultaneously display symbols selected from symbol groups.

BACKGROUND OF THE INVENTION

At least some known gaming systems display video based games such as bingo-type games that allow players to purchase bingo cards for use in playing the bingo-type game. Each bingo card includes a randomly selected sub-set of numbers from a pre-defined set of numbers. During play of the bingo-type game, the gaming system conducts a draw in which a plurality of numbers are randomly selected from the predefined set of numbers. During the draw, the player compares the drawn number with the numbers displayed on the purchased bingo cards to determine if a match occurs between the drawn number and the numbers displayed on the bingo cards. The player marks, or daubs, each corresponding matched number on the bingo card and indicates a winning outcome when the matched numbers forms a complete row and/or column on the bingo card. The gaming system verifies the winning outcome and responsively provides an award to the player based on the winning outcome indicated on the bingo card.

Over time, during game play, the player may become frustrated because the chances of receiving an award are based only on the number of matches made between the numbers selected during the draw and the predefined set of numbers displayed on the player's bingo card. Accordingly, new features are necessary to appeal to player interest and enhance excitement in order to entice longer play and increased profitability. The present invention is directed to satisfying these needs.

SUMMARY OF THE INVENTION

The invention is generally directed to systems and methods for allowing players to play bingo-type games having a set of game symbols being selected from each of a plurality of symbols groups and simultaneously displaying the set of game symbols for a predefined period of time.

In one aspect of the invention, a system for allowing players to play a bingo-type game with a user computing device is provided. The system includes a database including a plurality of bingo symbols and a system controller coupled to the database. The system controller is configured to receive, from at least one user computing device, a request from a player to play the bingo-type game and responsively display the bingo-type game on the at least one user computing device. The bingo-type game includes a display area having a plurality of player symbols being displayed in a grid. The system controller is configured to determine a plurality of symbol groups included in the bingo-type game, randomly select a set of bingo symbols, and displays the selected set of bingo symbols with respect to the symbol grid. Each symbol group includes a predefined set of bingo symbols. The set of bingo symbols including a bingo symbol selected from each one of the symbol groups. Each bingo symbol in the set of bingo symbols being displayed simultaneously. The system controller determines if each of bingo symbols matches a corresponding one of the plurality of player symbols, determines an outcome of the bingo-type game as a function of the matched player symbols, and provides the player an award as a function of the determined game outcome.

In another aspect of the invention, a method for allowing players to play a bingo-type game with a gaming system is provided. The gaming system includes a controller that is in communication with a display device and a user input device. The method includes displaying the bingo-type game on the display device. The bingo-type game includes a display area having a plurality of player symbols being displayed in a grid. The method includes determining a plurality of symbol groups included in the bingo-type game, randomly selecting a set of bingo symbols, and displaying the selected set of bingo symbols with respect to the symbol grid. Each symbol group includes a predefined set of game symbols. The set of bingo symbols including a bingo symbol selected from each one of the symbol groups. Each bingo symbol in the set of bingo symbols is displayed simultaneously. The method includes determining if each of bingo symbols matches a corresponding one of the plurality of player symbols, determining an outcome of the bingo-type game as a function of the matched player symbols, and providing the player an award as a function of the determined game outcome.

In yet another aspect of the invention, one or more non-transitory computer-readable storage media, having computer-executable instructions embodied thereon is provided. The computer-executable instructions, when executed by at least one processor, cause the processor to display a bingo-type game on a display device. The bingo-type game includes a display area having a plurality of player symbols being displayed in a grid. The processor determines a plurality of symbol groups included in the bingo-type game, randomly selects a set of bingo symbols, and displays the selected set of bingo symbols with respect to the symbol grid. Each symbol group includes a predefined set of game symbols. The set of bingo symbols includes a bingo symbol selected from each one of the symbol groups. Each bingo symbol in the set of bingo symbols is displayed simultaneously. The processor determines if each of bingo symbols matches a corresponding one of the plurality of player symbols, determines an outcome of the bingo-type game as a function of the matched player symbols, and provides the player an award as a function of the determined game outcome.

BRIEF DESCRIPTION OF THE DRAWINGS

Other advantages of the invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
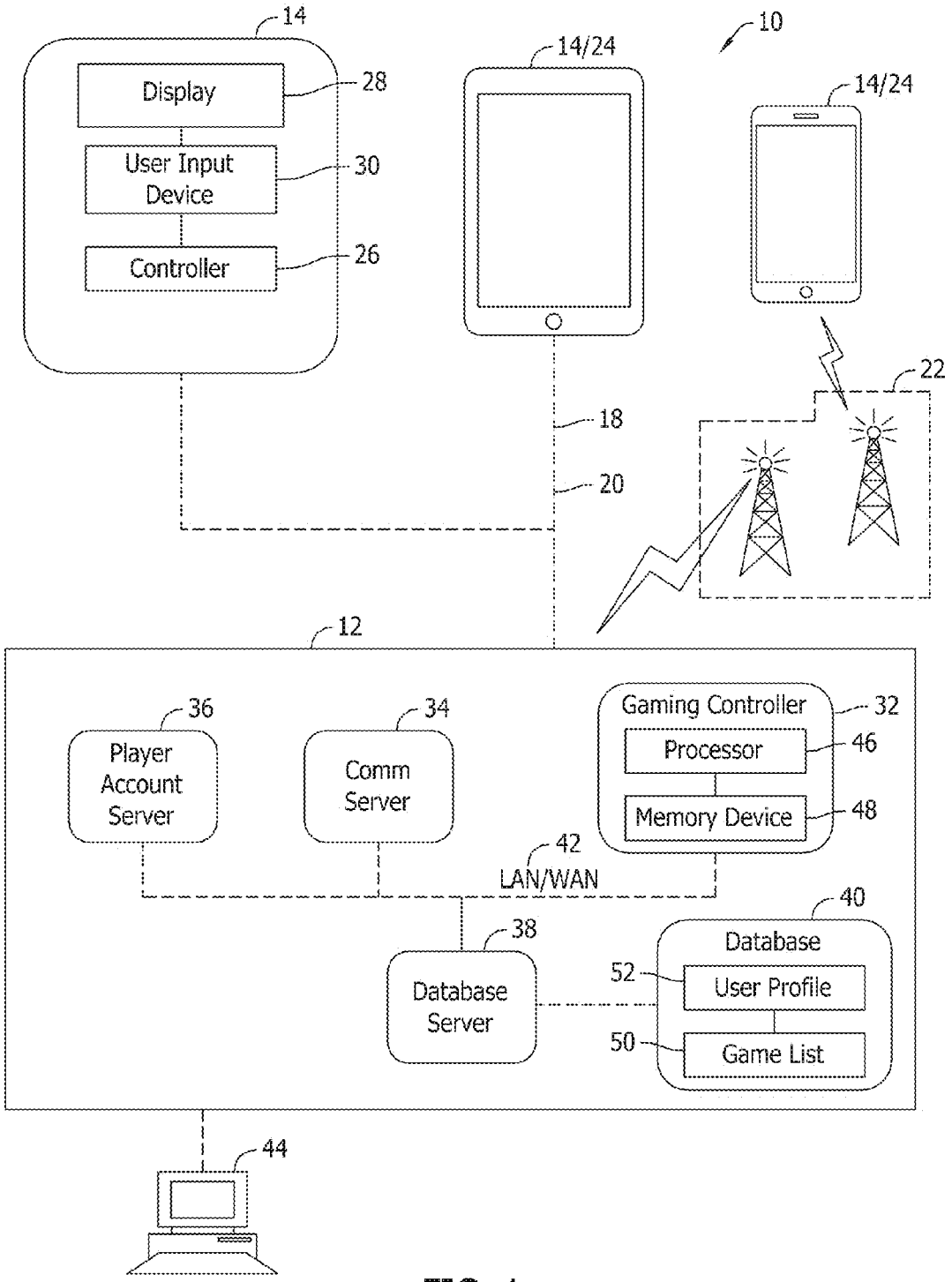
FIG. 1 is a schematic representation of an exemplary system for allowing a player to play a bingo-type game, according to an embodiment of the invention.

The exemplary embodiments herein relate to matching-type games. It should be understood that each of the methods and individual steps recited herein may be partially or wholly carried out in a variety of ways and/or systems, which may include, but are not limited to, a live dealer physically dealing playing cards in a casino, a dealer providing a plurality of bingo cards that includes randomly selected bingo symbols, an electronic gaming machine (EGM) for use by one or more players, a multiplayer platform which may include a player interface such as a touchscreen display and involve physical or virtual bingo cards, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve wagering, the generation of random data, the application of randomly-generated data to predefined rules, the determination of wager outcomes in accordance with preset outcome determining criteria, the notification of such outcomes, awarding of payouts and collecting of wagers. The generation of random data may be facilitated by computerized and/or physical implements. The transformative events may also include parsing of the data for comparative purposes with preset criteria to determine an outcome in a second, bonus or associated wagering game.

With reference to the drawings and in operation, the invention overcomes at least some of the disadvantages of known systems by providing, among other things, systems and methods which enable a plurality of players to play a bingo-type game that displays a bingo card that includes a plurality of symbol groups, selects a set of game symbols including a game symbol from each symbol group during each symbol draw, and simultaneously displays each game symbol in the selected set for a limited period of time to enable the player to match the displayed game symbols with the bingo card symbols. In addition, the system may provide an award to each player that obtains a winning combination of matched symbols within a predefined period of time. Moreover, the system may select a number of available awards that is less than the number of players, and provide the awards to the players based on the speed, timing, and/or order in which the players obtain a winning combination.

By simultaneously displaying each game symbol in the selected set of game symbols for a limited period of time, and by providing awards based on the order in which the players indicate a winning combination, the excitement and interest of the players is increased because each player only has a limited amount of time to view the set of selected game symbols, thus increasing the amount of bingo cards purchased by the player and increasing the amount of revenue received from the purchases.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a schematic representation of the system 10, according to an embodiment of the invention. In the illustrated embodiment, the system 10 includes a server system 12 that is coupled to one or more user computing devices 14. Each user computing device 14 is configured to transmit and receive data to and/or from the server system 12 to display graphical interfaces 16 such as, for example, a game screen (shown in FIGS. 4-6) to enable a user to participate in bingo-type games via the user computing device 14. In the illustrated embodiment, the server system 12 is coupled to each user computing device 14 via a communications link 18 that enables each user computing device 14 to access server system 12 over a network 20, such as the Internet, a cellular telecommunications network 22, a wireless network and/or any suitable telecommunication network that enables the user computing devices 14 to access the server system 12. For example, in one embodiment, the user computing device 14 includes a mobile computing device 24, e.g. a smartphone that communicates with the server system 12 via the cellular telecommunications network 22 and/or the Internet. In another embodiment, the user computing device 14 may include a personal computer, laptop, cell phone, tablet computer, smartphone/tablet computer hybrid, personal data assistant, and/or any suitable computing device that enables a user to connect to the server system 12 and display the graphical interfaces 16.

In the illustrated embodiment, each user computing device 14 includes a controller 26 that is coupled to a display device 28 and a user input device 30. The controller 26 receives and transmits information to and from the server system 12 and displays the graphical interface 16 (shown in FIGS. 4-6) on the display device 28 to enable the user to interact with the server system 12 to play the games in accordance with the embodiments described herein. The display device 28 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 30 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 26 and/or to retrieve data from the controller 26. Alternatively, a single component, such as a touch screen, a capacitive touch screen, and/or a touchless screen, may function as both the display device 28 and as the user input device 30.

In the illustrated embodiment, the server system 12 includes a gaming controller 32, a communications server 34, a player account server 36, a database server 38, and a database 40. The servers 34, 36, and 38, gaming controller 32, and database 40 are connected through a network 42 such as, for example, a local area network (LAN), a wide area network (WAN), dial-in-connections, cable modems, wireless modems, and/or special high-speed Integrated Services Digital Network (ISDN) lines. Moreover, at least one administrator workstation 44 is also connected to the network 42 to enable communication with the server system 12. Alternatively, the workstation 44 may be coupled to the network 42 using an Internet link or may be coupled through an intranet.

The communications server 34 communicates with the user computing devices 14 and the administrator workstation 44 to facilitate transmitting data over the network 20 via the Internet and/or the cellular network 22, respectively.

The database server 38 is connected to the database 40 to facilitate transmitting data to and from the database 40. The database 40 contains information on a variety of matters, such as, for example, account information related to a user, user profile information, a game type, a number of game symbols associated with a game, a number of bingo symbols associated with a game, a type of bingo symbol, an amount of symbol positions groups associated with a game, an amount of symbol groups associated with a game, a number of symbol groups associated with a wager, an amount of game symbols included in each symbol group, and image data for producing game images and/or screens on the user computing device 14. In one embodiment, the database 40 includes a centralized database that is stored on the server system 12 and is accessed directly via the user computing devices 14. In an alternative embodiment, the database 40 is stored remotely from the server system 12 and may be non-centralized.

The gaming controller 32 includes a processor 46 and a memory device 48 that is coupled to the processor 46. The memory device 48 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 46 to store, retrieve, and/or execute instructions and/or data.

The processor 46 executes various programs, and thereby controls other components of the server system 12 and the user computing device 14 according to user instructions and data received from the user computing devices 14. The processor 46 in particular displays the graphical interfaces 16 (shown in FIGS. 4-6) and executes a game program, and thereby enables the system 10 to generate games and allow the user to play the games in response to user instructions received via the user computing devices 14 in accordance with the embodiments described herein. The memory device 48 stores programs and information used by the processor 46. Moreover, the memory device 48 stores and retrieves information in the database 40 including, but not limited to, image data for producing images and/or screens on the display device 28, and temporarily stores variables, parameters, and the like that are used by the processor 46. In addition, the memory device 48 may store a game list 50 in the database 40 that includes data related to a collection of simulated casino-type games (shown in FIGS. 4-10) that are available for play via the user computing device 14. The simulated casino-type games may include, but are not limited to, a bingo-type game, a video slot game, a keno game, a blackjack game, a video craps game, a video poker game, or any casino-type of game which allows a player to place a wager, play a game, and potentially provide the player an award. In addition, the game list 50 may include game indicia, symbol weights, paytables, and/or winning combination tables which represent relationships between combinations of random numbers, combinations of symbol matches and types of awards associated with each game.

In the illustrated embodiment, the gaming controller 32 includes multiple instances of a game such that each user computing device 14 may play a separate instance of the game simultaneously. In addition, the gaming controller 32 enables players on one or more user computing devices 14 to simultaneously play the same game.

In the illustrated embodiment, the player account server 36 stores information associated with a plurality of user profile accounts and a plurality of corresponding unique user identifiers in a user profile program 52 in the database 40. In the illustrated embodiment, the player account server 36 uses the unique user identifier to identify the user profile account associated with the unique user identifier and provide the user access to the server system 12 to initiate a gaming session via a user computing device 14. In one embodiment, the unique user identifier may include a combination of a username and password. Alternatively, in another embodiment, the unique user identifier may include a personal identification number, or a random identification number assigned to a corresponding user account. For example, in one embodiment, the unique user identifier may include a mobile device identifier, such as, for example, a cellular phone number and/or wireless internet address for identifying a user computing device 14 associated with a user account.

In one embodiment, each user profile account may include personal identification information such as, for example, a user name, address, personal identification number, date of birth, email address, mobile phone number, and/or any suitable information that enables the player account server 36 to identify a user. In addition, the user profile account may include player tracking information such as, for example, a type of game previously played by the player, a frequency in which the player plays a game, the average number of games played over a predefined period of time, the average credit wager the player makes per play of a game, a total amount wagered by the player over a predefined period of time, and/or any other suitable player tracking information. In addition, the user profile account may also include a list of preferred game categories such as, for example, type of games, amount of wagers made per game, number of games to be played simultaneously, total amount of wagers made during gaming session, and/or any information related to a preferred game environment that enables the system 10 to function as described herein.

In the illustrated embodiment, each user profile account also includes financial account information associated with each user. The financial account information may include, but is not limited to, an amount of game credits available for use in playing games, available monetary funds for use in purchasing game credits, an available game credit account balance, and/or any suitable financial information that enables the system 10 to function as described herein.

In the illustrated embodiment, the workstation 44 includes a display and user input device to enable an administrative user to access the server system 12 to transmit data indicative of the game and/or awards to the database server 38. This enables an administrative user to periodically update the game list, game types, user profile accounts, and/or any suitable data and information that enables the system 10 to function as described herein.

Figure 2:
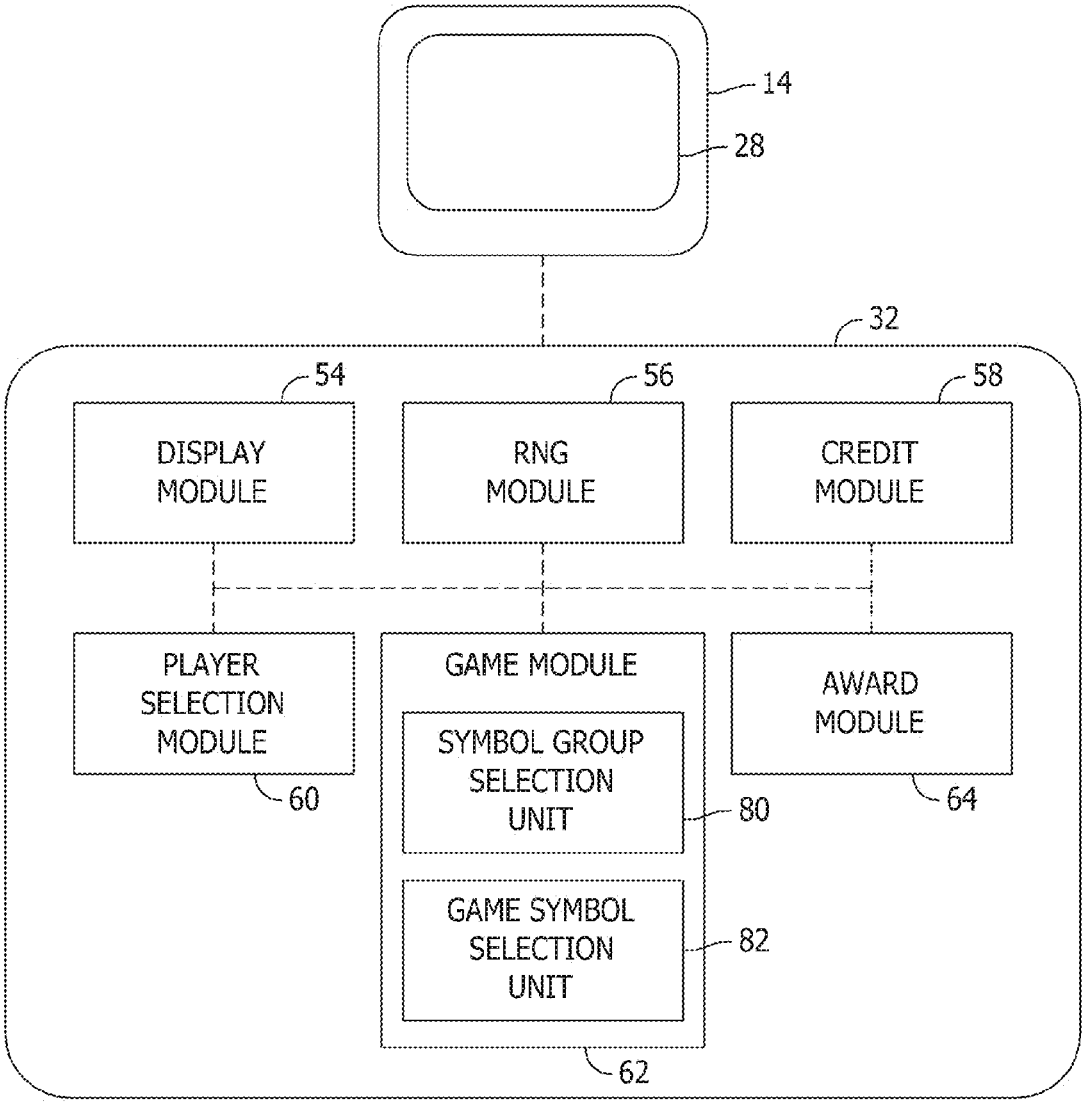
FIG. 2 is schematic view of a gaming controller that may be used with the system shown in FIG. 1.

FIG. 2 is schematic view of the gaming controller 32. In the illustrated embodiment, the gaming controller 32 includes a display module 54, a random-number generator (RNG) module 56, a credit module 58, a player selection module 60, a game module 62, and an award module 64.

The display module 54 controls the display device 28 to display various images on the graphical interface 16 preferably by using computer graphics and image data stored in the database 40. More specifically, the display module 54 controls the game symbols 66 being displayed in a game such as, for example, a bingo-type game 68 (shown in FIG. 4) on the display device 28 by using computer graphics and the image data. In the illustrated embodiment, the display module 54 displays the bingo-type game 68 including a plurality of player symbols 70 being displayed in at least one bingo card 72. The display module 54 may display the bingo card 72 including a plurality of symbol positions 74 being arranged in a grid 76, and may display each player symbol 70 in a corresponding symbol position 74. In the illustrated embodiment, the display module 54 also displays a plurality of user selection areas 78 (shown in FIG. 4) within the graphical interface 16 that correspond to specific operations that may be initiated by the user. For example, in the illustrated embodiment, the display module 54 displays each player symbol 70 including and associated selection area 78 to enable the user to select each displayed player symbol 70 to indicate a user's selection of the corresponding player symbol 70. Each of the selection areas 78 may receive a user selection input via the user input device 30.

The credit module 58 communicates with the player account server 36 to manage the amount of player's credits available for use in playing the bingo-type game 68. The credit module 58 receives a user selection indicative of a request from a user computing device 14 to play a game including an amount of game credits associated with the selected game. The credit module 58 sends a verification message to the player account server 36 including a unique user identifier and a game credit amount associated with the requested game play. The player account server 36 identifies the user profile account associated with the unique user identifier and determines if sufficient game credits are available in the user profile account as a function of the user request. If the player account server 36 determines sufficient game credits are available in the user profile account, the player account server 36 sends a verification message to the credit module 58 and deducts a corresponding amount of game credits from the user profile account. If the player account server 36 determines that the user profile account does not include a sufficient amount of game credits, the credit module 58 displays a message on the user computing device 14 requesting the user to purchase additional game credits corresponding to the request. In addition, the credit module 58 may also display an amount of game credits included in the user profile account that are available for use in playing and/or wagering on the games.

The game module 62 includes a game program for use in playing a game based on user selection input receive from a user computing device 14. The game module 62 receives game information from the game list 50 included in the database 40 and performs various functions and calculations to play the game according to a set of predefined game rules and player input. More specifically, the game module 62 retrieves game elements from the database 40, and causes the display module 54 to display the game on the display device 28. The game module 62 receives signals indicative of a user selection input via the user input device 30, generates an outcome of the game based on the predefined game rules and the received user selection input, and displays the game outcome on the display device 28.

The RNG module 56 generates and outputs random numbers to the game module 62 for use in playing the game 68. In addition, the game module 62 may use random numbers generated by the RNG module 56 to determine if a winning condition has occurred in the outcome of the game, and to determine whether or not to provide an award to a player. For example, if the game is the bingo-type game 68, the game module 62 uses the RNG module 56 to randomly select one or more bingo cards 72 (shown in FIGS. 4 and 5) including a plurality of player symbols 70 and/or bingo numbers for use during the bingo-type game 68. In addition, the game module 62 uses the RNG module 56 to randomly select a plurality of game symbols 66 during a symbol draw. The game module 62 compares the game symbols 66 selected during the draw with the player symbols 70 and/or numbers displayed in the selected bingo cards 72 to determine a number of player symbols 70 and/or numbers matching the randomly selected game symbols 66.

In the illustrated embodiment, the game module 62 includes a symbol group selection unit 80 and a game symbol selection unit 82. The symbol group selection unit 80 is configured to select a plurality of symbol groups 84 (shown in FIG. 7) being included in the bingo-type game 68 and to determine a number and/or type of game symbols 66 being included in each symbol group 84. In one embodiment, the symbol group selection unit 80 may identify a game type selected by the player from the game list 50 and determine a number of symbol groups 84 as a function of the selected game type. In another embodiment, the symbol group selection unit 80 may determine a number of symbol positions 74 being displayed with the bingo-type game 68 and determine a number of symbol groups 84 as a function of the number of symbol positions 74 displayed with the bingo-type game 68. For example, in one embodiment, the game module 62 may display the bingo-type game 68 including a bingo card 72 having a plurality of symbol positions 74 being arranged in a plurality of symbol position groups 86 such as, for example, a symbol column and/or symbol row. The symbol group selection unit 80 may determine a number of symbol position groups 86 being displayed with the bingo-type game 68 and determine a number of symbol groups 84 for use in the bingo-type game 68 as a function of the number of symbol position groups 86.

Figure 5:
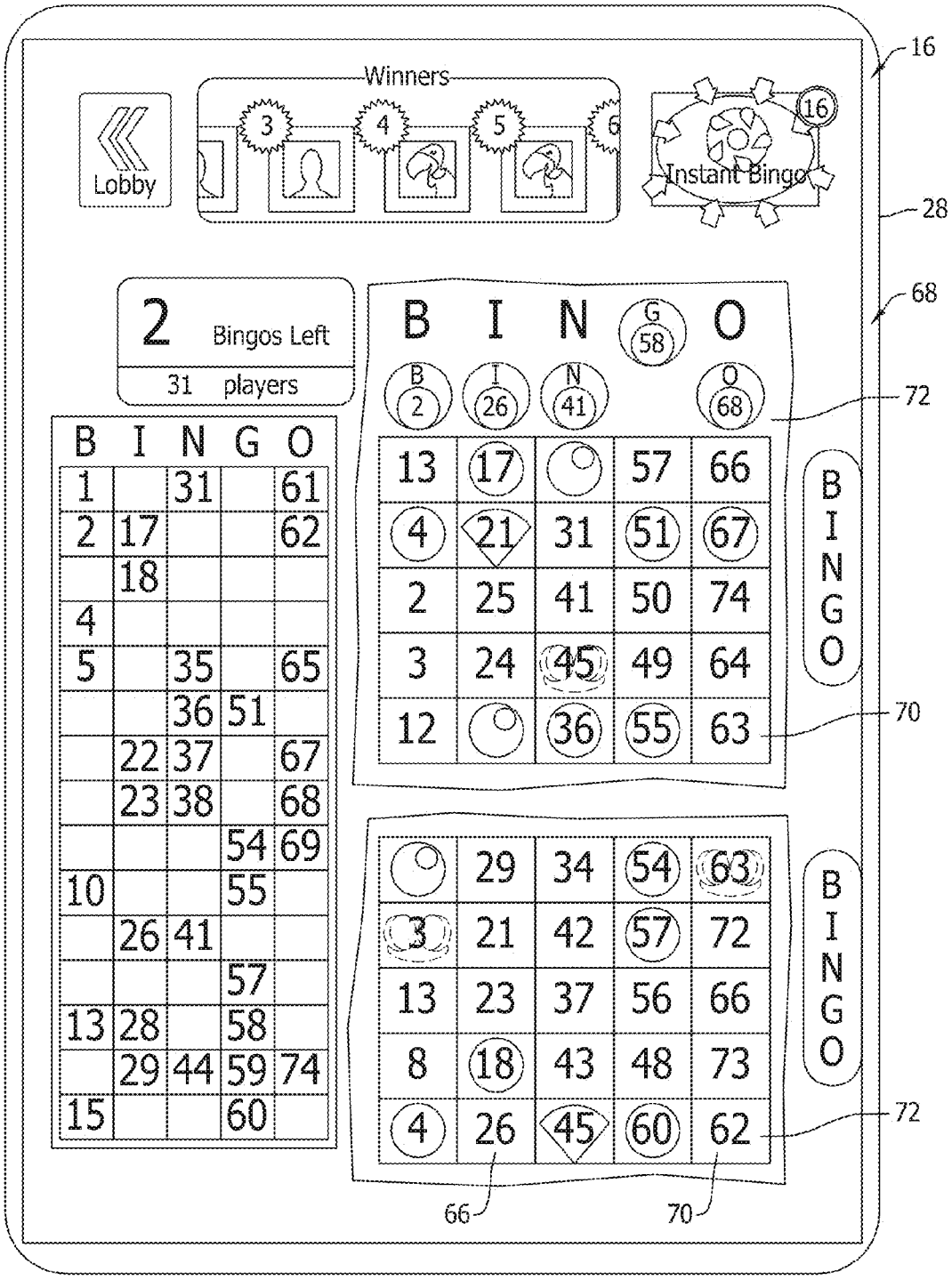
Figure 6:
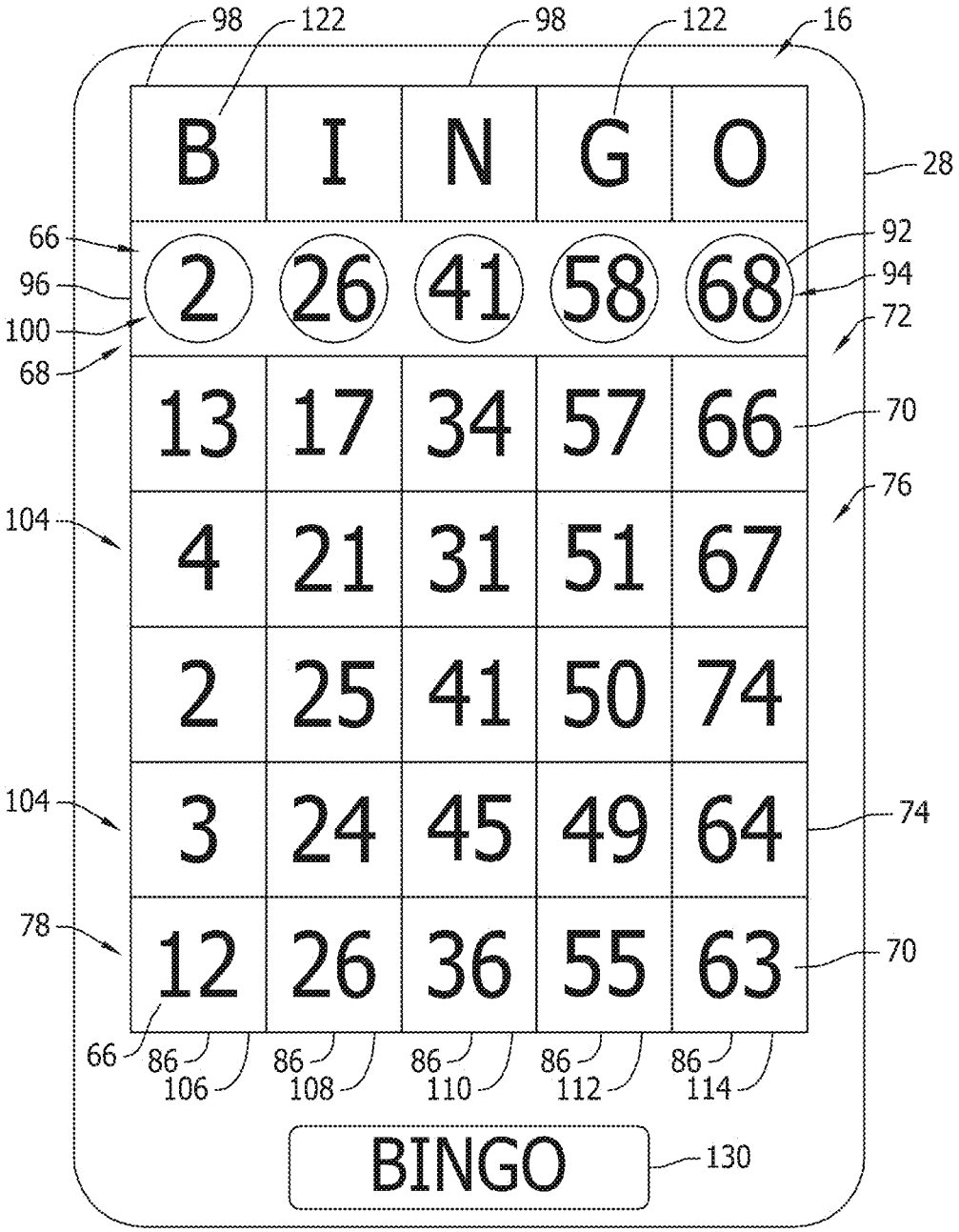

In one embodiment, for example, the display module 54 may display a bingo card 72 having a predefined number of symbol position groups 86 with each symbol position group 86 being displayed arranged in a column (shown in FIG. 6). The symbol group selection unit 80 may select a number of symbol groups 84 to be included in the bingo-type game 68 as a function of the displayed number of symbol position groups 86. As shown in FIGS. 5 and 6, in one embodiment, the display module 54 may display a bingo card 72 having 5 symbol position groups 86 being displayed in 5 columns. The symbol group selection unit 80 may select 5 symbol groups 84 for use in the bingo-type game 68 and assign each selected symbol group 84 to a corresponding to a symbol position group 86. In one embodiment, the game module 62 may receive a signal indicative of an amount of credits and/or a wager amount being used by the player to purchase one or more bingo cards 72 for use in the bingo-type game 68. The symbol group selection unit 80 may also determine a number of symbol groups 84 to be included in the bingo-type game 68 as a function of the received credits and/or wager.

Figure 7:
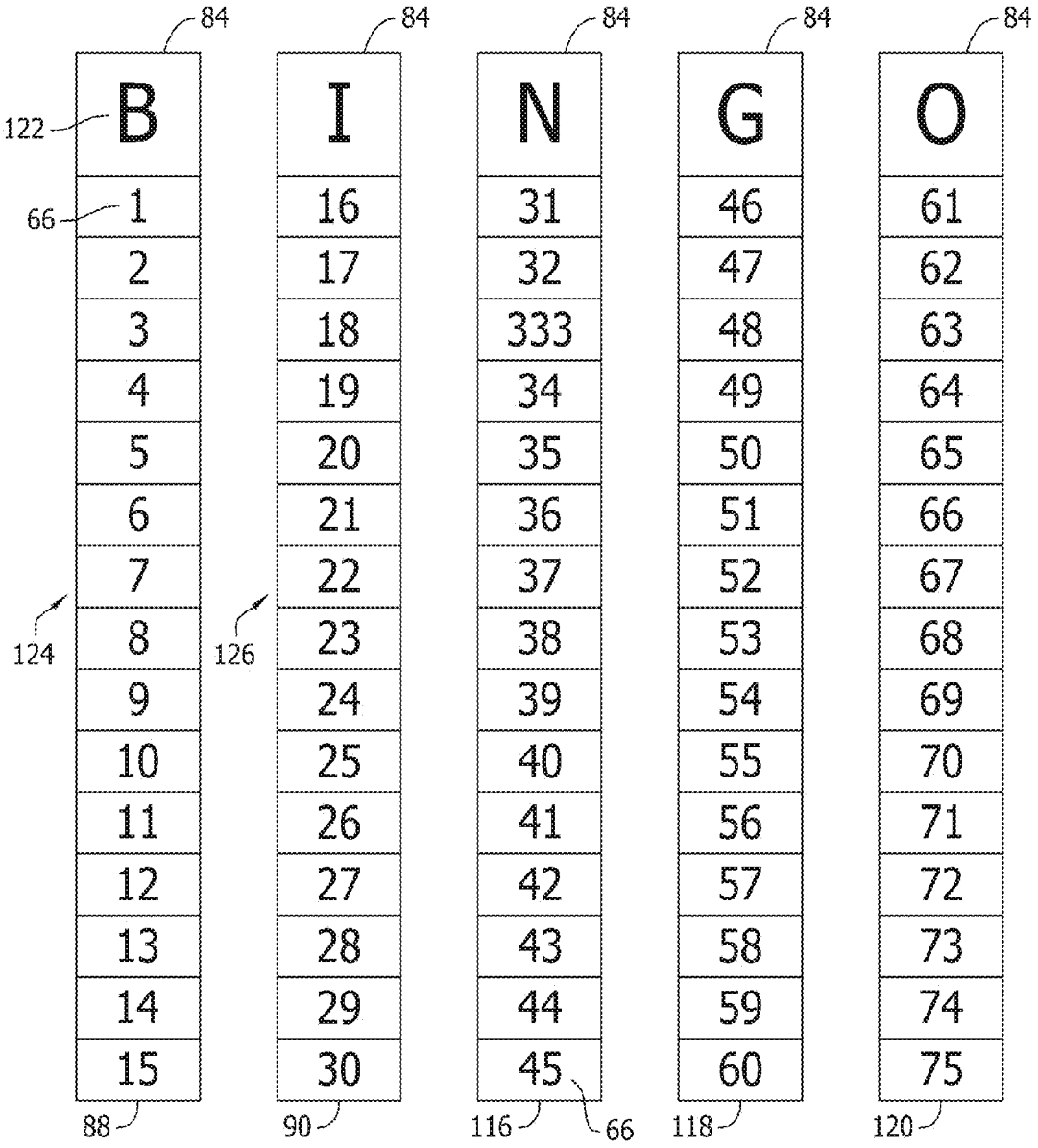
FIG. 7 is a schematic illustration of symbol groups that may be used with the bingo-type game shown in FIGS. 4-6, according to an embodiment of the present invention.

In the illustrated embodiment, each symbol group 84 includes a predefined set of game symbols 66. In one embodiment, the symbol group selection unit 80 may select a first symbol group 88 having a first set of game symbols 66 and a second symbol group 90 that includes a second set of game symbols 66 that is different from the first set (shown in FIG. 7). For example, as shown in FIG. 7, in one embodiment, the game symbols 66 may include a plurality of bingo numbers. The symbol group selection unit 80 may define the first symbol group 88 to include bingo numbers 1 through 15, and define the second symbol group 90 to include bingo numbers 16-30.

In the illustrated embodiment, the game symbol selection unit 82 is configured to randomly select game symbols 66 from each of the selected symbol groups 84 for use in the bingo-type game 68. For example, in one embodiment, the game symbol selection unit 82 may be configured to randomly select a plurality of player symbols 70 from each selected symbol group 84 and display the selected player symbols 70 in one or more bingo cards 72. The game symbol selection unit 82 may also randomly select a plurality of bingo symbols 92 from each of the symbol groups 84 and determine if each selected player symbol 70 matches a selected bingo symbol 92.

In the illustrated embodiment, the game symbol selection unit 82 is configured to conduct a plurality of symbol draws during the bingo-type game 68 to select and display the plurality of bingo symbols 92 to the player. More specifically, during each symbol draw, the game symbol selection unit 82 is configured to randomly select a set 94 of bingo symbols 92 and display the selected set 94 of bingo symbols 92 in the game screen 16. The game symbol selection unit 82 is configured to select a bingo symbol 92 from each of the selected symbol groups 84 to form the selected set 94 of bingo symbols 92. The game module 62 causes the display module 54 to simultaneously display each selected bingo symbol 92 in the set 94 in a bingo set display area 96 (shown in FIGS. 6 and 9) for a predefined period of time. For example, as shown in FIGS. 4-8, in one embodiment, during a symbol draw, the game symbol selection unit 82 randomly selects a set 94 of bingo symbols 92 including a bingo symbol 92 selected from each symbol group 84 associated with a corresponding symbol column 98. The display module 54 displays the selected set 94 of bingo symbols 92 in the bingo set display area 96 and displays each selected bingo symbol 92 with respect to each corresponding symbol column 98. The display module 54 displays the set 94 of bingo symbols 92 for a predefined period of time to allow the player to indicate any player symbols 70 that match the displayed bingo symbols 92.

In the illustrated embodiment, the game module 62 generates a plurality of symbol draws and, for each symbol draw, randomly selects a set 94 of bingo symbols 92 and displays the set 94 of bingo symbols 92 for a predefined period of time to allow the player to indicate any matched player symbols 70 during the predefined period of time. By simultaneously displaying each bingo symbol 92 of the selected set 94 of bingo symbols 92 for a predefined period of time, the excitement and interest of the players is increased because each player only has a limited amount of time to view the selected bingo symbols 92 and indicate a matched player symbol 70 to obtain a winning combination.

In one embodiment, the game module 62 may generate a first symbol draw including randomly selecting a first set of bingo symbols and displaying the first set of bingo symbols in the bingo set display area 96 for a predefined period of time. The game module 62 may also generate a second symbol draw including randomly selecting a second set of bingo symbols, removing the first set of bingo symbols from the bingo set display area 96, and displaying the second set of bingo symbols in the bingo set display area 96 after the first set of bingo symbols has been removed. In another embodiment, during a symbol draw, the game module 62 may select a first set 100 of bingo symbols 92 and a second set 102 of bingo symbols 92 (shown in FIG. 9) and simultaneously display the first and second sets 100 and 102 in the bingo set display area 96 for a predefined period of time.

In the illustrated embodiment, the player selection module 60 receives a user selection input from the input device 30, selects player symbols 70 based on the player's selection, and displays a notification indicative of the player's selection on the graphical interface 16. In addition, the player selection module 60 transmits the player's selection to the game module 62 for use in determining if a player's symbol selection matches a selected bingo symbol 92. In one embodiment, the player selection module 60 may receive the selected bingo symbol 92 from the game module 62 and select the corresponding player symbol 70 without input from the user.

In the illustrated embodiment, the game module 62 determines if each of the bingo symbols 92 matches a corresponding one of the plurality of player symbols 70, determines an outcome of the bingo-type game 68 including any determined symbol matches, and transmits the game outcome to the award module 64. The award module 64 compares the game outcome with winning combinations stored in a winning combination table to determine if the symbol matches include a winning outcome that is associated with a type of award. In addition, the award module 64 may determine if a triggering condition occurred in the bingo-type game and provides an additional award such as, for example, a bonus feature game and/or an enhanced award based on the triggering condition.

Figure 3:
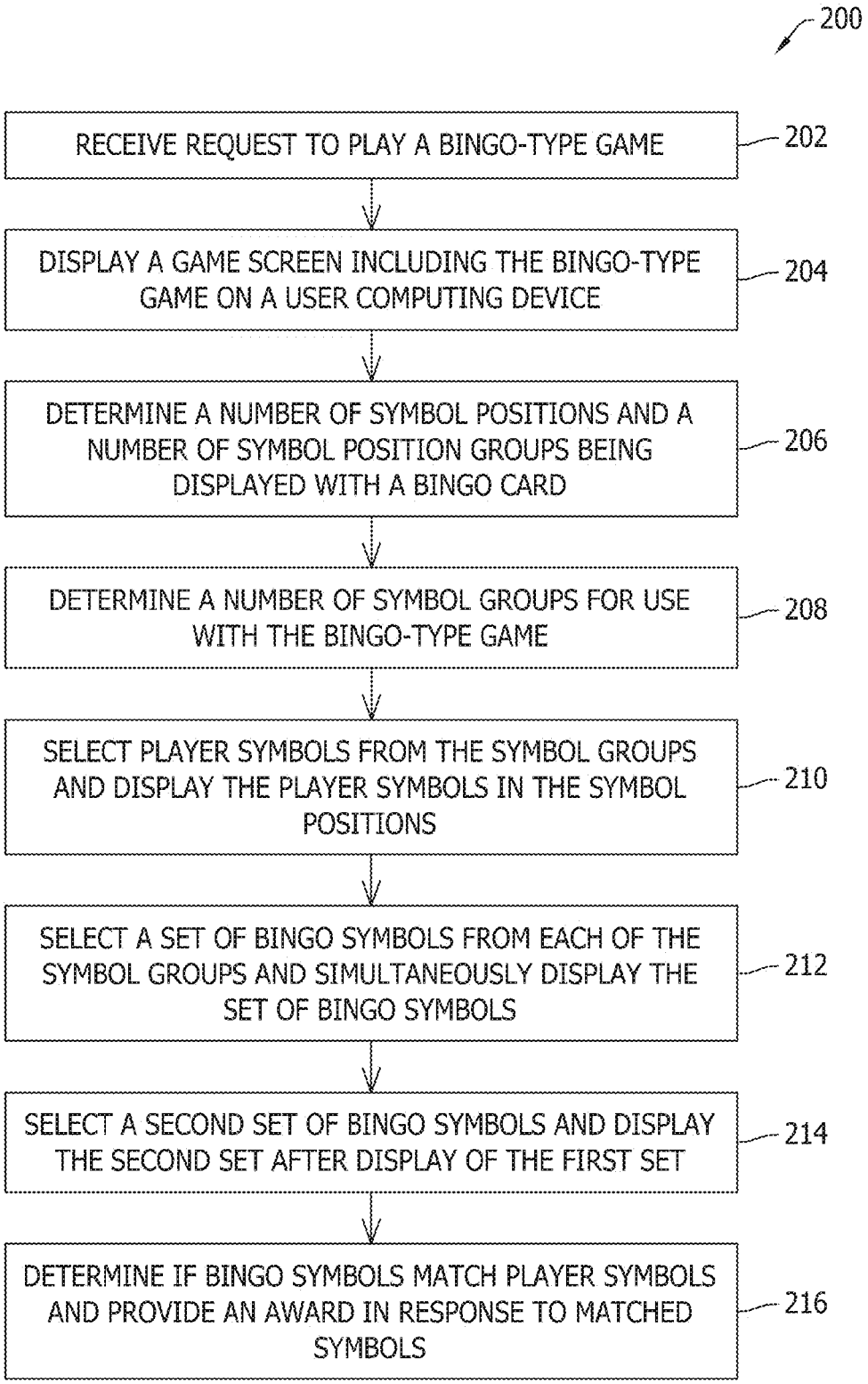
FIG. 3 is a flowchart of a method that may be used with the system shown in FIG. 1 for allowing a player to play a game via a user computing device, according to an embodiment of the invention.

FIG. 3 is a flowchart of a method 200 that may be used with the system 10 for allowing a player to play a game via a user computing device 14. Each method step may be performed independently of, or in combination with, other method steps. Portions of the method 200 may be performed by any one of, or any combination of, the components of the system 10.

Figure 4:
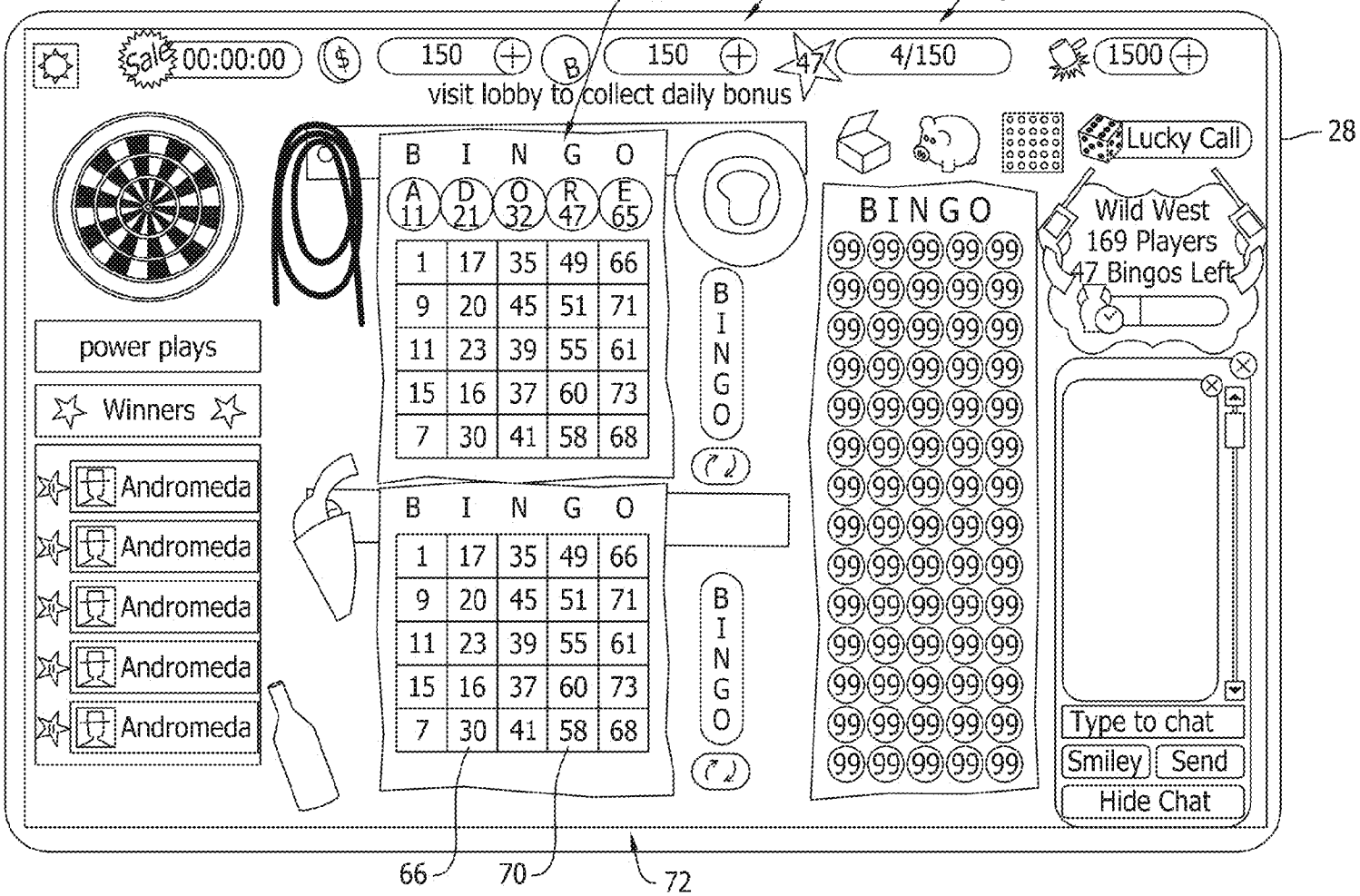
FIGS. 4-6 are exemplary entertaining graphical display of a bingo-type game that may be used with the method shown in FIG. 3, according to an embodiment of the present invention.
Figure 8:
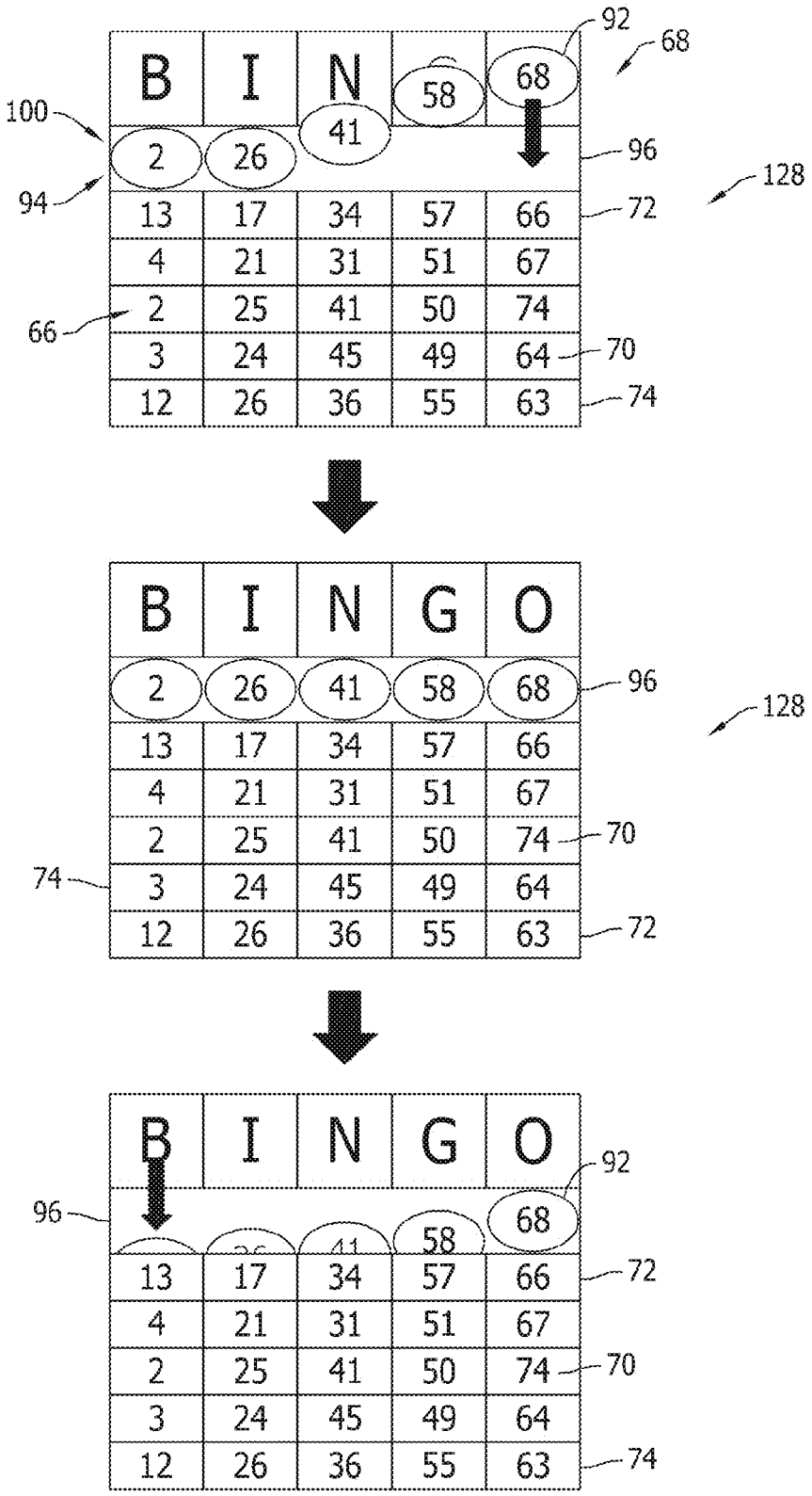
FIG. 8 is series of graphical displays of the bingo-type game shown in FIGS. 4-6 that may be used with the method shown in FIG. 3.
Figure 9:
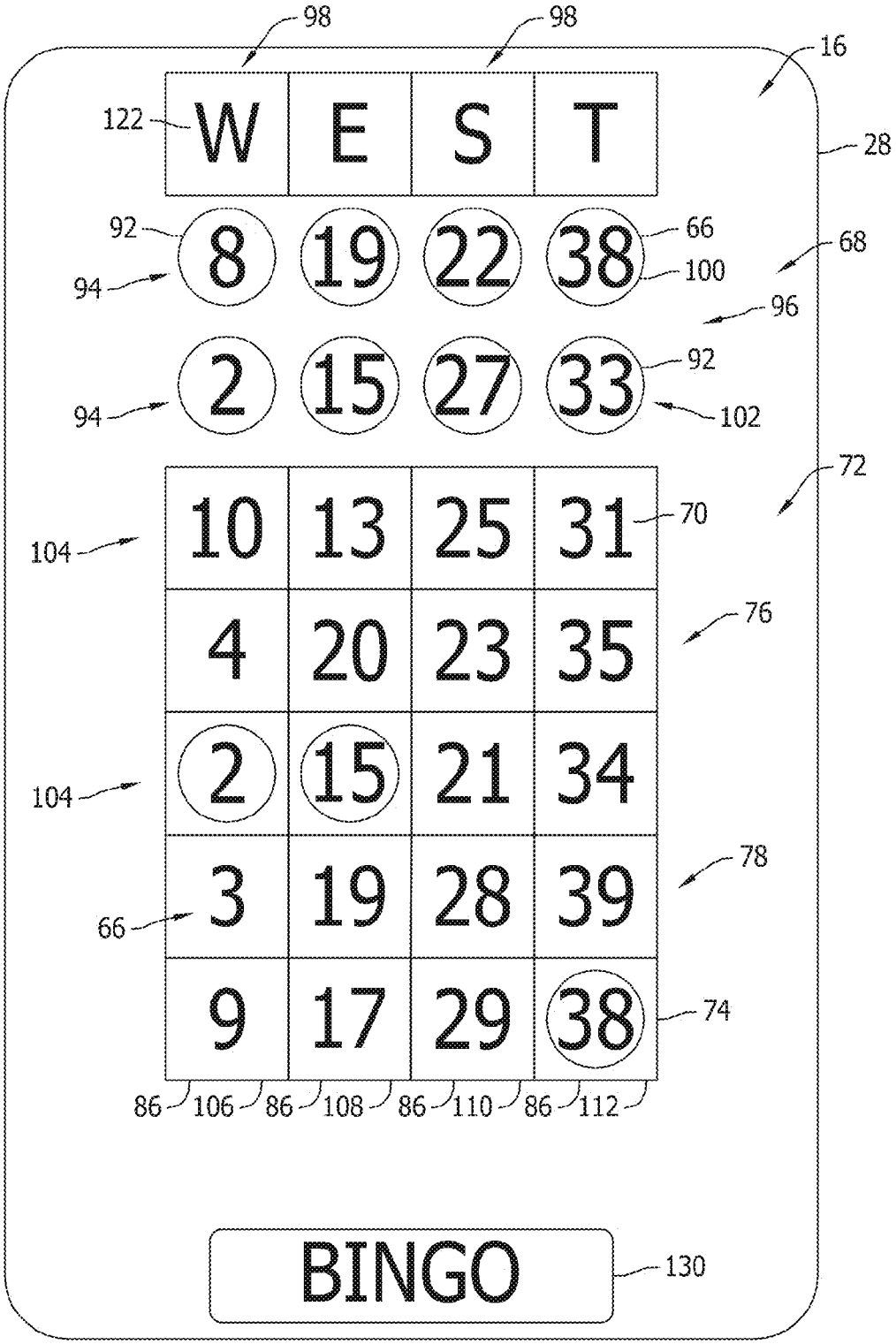
FIG. 9 is another exemplary entertaining graphical display of a bingo-type game that may be used with the method shown in FIG. 3, according to an embodiment of the present invention.
Figure 10:
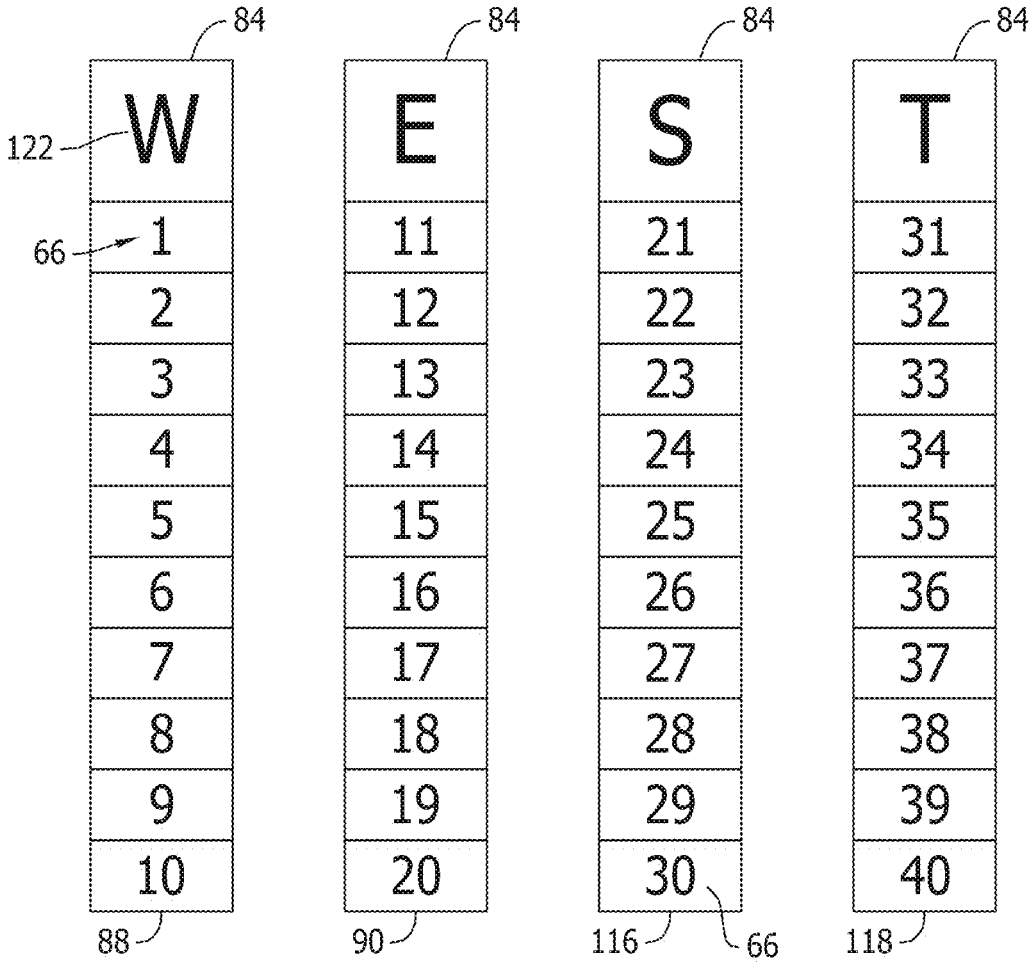
FIG. 10 is a schematic illustration of symbol groups that may be used with the bingo-type game shown in FIG. 9, according to an embodiment of the present invention.

FIGS. 4-6 are exemplary entertaining graphical display of the bingo-type game 68 that may be player with the system 10. FIG. 7 is a schematic illustration of symbol groups 84 that may be used with the bingo-type game 68. FIG. 8 is series of graphical displays of the bingo-type game 68 that may be played with the system 10. FIG. 9 is another exemplary entertaining graphical display of the bingo-type game 68 and FIG. 10 is a schematic illustration of symbol groups 84 that may be used with the bingo-type game 68 shown in FIG. 9. In the illustrated embodiment, entertaining graphical displays for amusement purposes are presented by the user computing device 14 via the display device 28 (shown in FIG. 1) and may receive input (e.g., selections and/or entries) via the user input device 30 (shown in FIG. 1). For example, in one embodiment, a selection may be received via user input device 30 of the user computing device 14 and may be transmitted by the user computing device 14 to the server system 12 via the network 20.

In the illustrated embodiment, in the method step 202, the gaming controller 32 receives a request from a player to play the bingo-type game 68 from a user computing device 14. In one embodiment, the player may submit the request by accessing a website via the communications server 34. In another embodiment, the player may access a mobile website via the cellular network 22. In addition, in one embodiment, the method step 202 may include receiving, by the gaming controller 32, a unique user identifier to validate the request to display the bingo-type game 68. More specifically, the display module 54 may display a login screen (not shown) on the user computing device 14 to request the unique user identifier such as, for example requesting a username and/or password. The gaming controller 32 receives the unique user identifier and transmits a validation request including the user credentials to the player account server 36. The player account server 36 compares the received unique user identifier with the collection of unique user identifier contained in the user profile program to validate the unique user identifier and responsively sends a validation message to the gaming controller 32 if the received unique user identifier is included in the user profile program. Upon receiving the validation message from the player account server 36, the gaming controller 32 displays a listing of available games from the game list 50. In addition, in one embodiment, if the received user identifier is not included in the user profile program, the gaming controller 32 may prompt the user to establish a user account and/or display the available games without requiring the user to establish a user account and/or verify a user account. In addition, in one embodiment, method step 202 may also include receiving a wager from the player and/or receiving a request to purchase a play of the game with game credits from the corresponding user profile account.

In method step 204, the gaming controller 32 displays a game screen 16 including a game in response to the request received from the player via the user computing device 14. In the illustrated embodiment, the gaming controller 32 displays the bingo-type game 68. However, it should be noted that the gaming controller 32 may display any type of game included in the game list 50 and upon which a player could make a wager and/or purchase a game play including, but not limited to a slot game, a blackjack game, a video poker game, or any type of game that enables the system 10 to function as described herein. In general, during method step 204, the gaming controller 32 displays the bingo-type game 68 game including one or more bingo cards 72. Each bingo card 72 includes a plurality of symbol positions 74 being displayed with a corresponding player symbol 70 that is selected from a predefined set of game symbols 66. In one embodiment, the plurality of game symbols 66 may include numbers and/or a combination of letters and numbers. Alternatively, the plurality of game symbols 66 may include any symbol that may be selected from a predefined set of associated symbols.

In one embodiment, the gaming controller 32 may display the game 68 including a plurality of bingo cards 72 determined as a function of the player's wager and/or a number of game plays purchased by the player using game credits. For example, in one embodiment, the gaming controller 32 receives a wager from the player and receives a player selection input indicative of a number of bingo cards 72 to be purchased with the wager for use in the bingo-type game 68, and displays the selected number of bingo cards 72.

In method step 206, the gaming controller 32 determines a number of symbol positions 74 being displayed with each bingo card 72 and determines a number of symbol position groups 86 being displayed with each bingo card 72. In one embodiment, the gaming controller 32 may determine the number of symbol positions 74 being displayed with the bingo card 72 as a function of the game being selected by the player. For example, in one embodiment, one or more games contained in the game list 50 may be associated with bingo cards 72 having different amounts of symbol positions 74 being displayed with the corresponding bingo cards 72. In addition, the gaming controller 32 may determine the number of symbol positions 74 being displayed as a function of the amount of credits received from the player for the purchase of the bingo card 72. For example, the gaming controller 32 may allow the player to purchase a bingo card 72 having a larger amount of symbol positions 74 with a corresponding larger amount of credits required for the purchase and/or allow a player to purchase a bingo card 72 having a smaller amount of symbol positions 74 corresponding to a smaller amount of required credits. In another embodiment, each game contained in the game list 50 may include a predefined amount of symbol positions 74 associated with a bingo card 72.

Each player symbol 70 is displayed in a corresponding symbol position 74 that is displayed in a grid 76 and arranged along a plurality of rows 104 and a plurality of columns 98. In the illustrated embodiment, the bingo card 72 displays a total of 25 player symbols 70 displayed within the grid 76 arranged in 5 rows 104 and 5 columns 98 in a "5×5" arrangement. Alternatively, any number of player symbols 70 may be displayed in any suitable grid arrangement including, for example, 20 player symbols 70 displayed in a 4×5 arrangement (see FIG. 9), 9 player symbols 70 displayed in a 3×3 arrangement, and/or any suitable number of player symbols 70 displayed in any suitable row 104 and column 98 combination to enable the gaming controller 32 to function as described herein. In addition, the grid 76 may be displayed with a plurality of shapes such as, for example, a rectangle, a square, a diamond, a circle, and/or any suitable shape that enables the gaming controller 32 to function as described herein.

In the illustrated embodiment, the gaming controller 32 determines the number of symbol position groups 86 being displayed with the bingo-type game 68 and displays each symbol position group 86 in a corresponding column 98. For example, as shown in FIG. 6, in one embodiment, the gaming controller 32 may determine that the bingo-type game 68 is being displayed with 5 symbol position groups 86 and display each symbol position group 86 in 5 corresponding symbol columns 98.

In method step 208, the gaming controller 32 determines a plurality of symbol groups 84 for use with the bingo-type game 68. Each symbol group 84 includes a predefined set of game symbols 66. In the illustrated embodiment, the gaming controller 32 selects a number of symbol groups 84 as a function of the number of symbol position groups 86 being displayed with the game 68. For example, as shown in FIG. 6, in one embodiment, the gaming controller 32 may display the bingo-type game 68 including 5 symbol position groups 86 being displayed in 5 corresponding symbol columns 98, i.e. a $1^{st}$ symbol column 106, a $2^{nd}$ symbol column 108, a $3^{rd}$ symbol column 110, a $4^{th}$ symbol column 112, and a $5^{th}$ symbol column 114. The gaming controller 32 may also select a plurality of symbol groups 84 including a first symbol group 88, a second symbol group 90, a third symbol group 116, a fourth symbol group 118, and a fifth symbol group 120.

In addition, the gaming controller 32 may display a group designation symbol 122 associated with each symbol group 84 in an area outside of the display grid 76. For example, the gaming controller 32 may display the letters "B", "I", "N", "G", and "O" corresponding to each column 98 and being displayed outside the grid 76 to facilitate identifying the corresponding symbol groups 84 to the player. In another embodiment, as shown in FIG. 9, the gaming controller 32 may select 4 symbol position groups 86 being displayed in the 4 symbol columns 98, and select 4 symbol groups 84 corresponding to each symbol column 98. In one embodiment, the gaming controller 32 may determine the number of symbol groups 84 being used in the bingo-type game 68 as a function of the amount of credits received from the player to play the game 68. For example, the gaming controller 32 may allow the player to purchase an amount of symbol groups 84 associated with the bingo card 72.

In one embodiment, each symbol group 84 includes a different set of game symbols 66 such that the first symbol group 88 has a first collection 124 of game symbols 66 and the second symbol group 90 has a second collection 126 of game symbols 66 that is different from the first collection 124. For example, as shown in FIG. 7, the first collection 124 may include bingo symbols "1-15", and the second collection 126 may include bingo symbols "16-30". In another embodiment, the first and second symbol groups 124 and 126 may include one or more of the same symbols.

In method step 210, the gaming controller 32 randomly selects a plurality of player symbols 70 from each of the symbol groups 84 and displays each of the selected player symbols 70 in a corresponding symbol position 74 in the grid 76. In the illustrated embodiment, each player symbol 70 being displayed in a symbol position group 86 is selected from a corresponding symbol group 84. For example, in one embodiment, the player symbols 70 being displayed in the $1^{st}$ symbol column 106 are selected from the corresponding first symbol group 88, and the player symbols 70 being displayed in the $2^{nd}$ symbol column 108 are selected from the corresponding second symbol group 90.

In method step 212, the gaming controller 32 conducts a symbol draw operation including randomly selecting a set 94 of bingo symbols 92 from each of the corresponding symbol groups 84. In method step 212, the gaming controller 32 displays the selected set 94 of bingo symbols 92 such that each bingo symbol 92 in the set 94 of selected bingo symbols 92 is displayed simultaneously. In the illustrated embodiment, as shown in FIG. 6, the gaming controller 32 may display the bingo-type game 68 with 5 columns 98. During each symbol draw operation, the gaming controller 32 randomly selects a set 94 of bingo symbols 92 including a bingo symbol 92 selected from the first symbol group 88, and second symbol group 90, the third symbol group 116, the fourth symbol group 118, and the fifth symbol group 120. The gaming controller 32 also displays the set 94 of bingo symbols 92 in the bingo set display area 96 that is orientated with respect to the grid 76 to facilitate identifying to the player each bingo symbol 92 with the corresponding symbol column 98. For example, as shown in FIG. 6, the gaming controller 32 may display the set 94 of bingo symbols 92 such that the bingo symbol 92 selected from the first symbol group 88 is being displayed with respect to the $1^{st}$ column 106 and the bingo symbol 92 selected from the second symbol group 90 is being displayed with respect to the $2^{nd}$ column 108 to allow the player to identify the selected bingo symbol 92 with player symbols 70 associated with the corresponding symbol group 84 and/or symbol column 98.

In method step 214, the gaming controller 32 conducts a subsequent symbol draw operation including randomly selecting another set 94 of bingo symbols 92 including a bingo symbol 92 being selected from each of the corresponding symbols groups 84, and displays the selected set 94 in the bingo set display area 96. In the illustrated embodiment, as shown in FIG. 8, during a first symbol draw operation 128, the gaming controller 32 may select a first set 100 of bingo symbols 92 and simultaneously display each bingo symbol 92 included in the first set 100 in the bingo set display area 96. In addition, the gaming controller 32 may also display each bingo symbol 92 included in the first set 100 in a "cascading" sequential order with the bingo symbol associated with the first symbol group 88 being displayed first, followed by each subsequent bingo symbol 92 of the first set 100 until each bingo symbol 92 in the first set 100 is displayed in the bingo set display area 96. The gaming controller 32 may also display the selected first set 100 for a predefined period of time to allow the player to identify matching player symbols 70 while the first set 100 is being displayed. The gaming controller 32 may then conduct a second symbol draw operation including randomly selecting a second set 102 of bingo symbols 92 (shown in FIG. 9), and remove the first set 100 of bingo symbols 92 from the bingo set display area 96 before displaying the second set 102 of bingo symbols 92. The gaming controller 32 may also remove each bingo symbol 92 from the bingo set display area 96 in "cascading" sequential order with the bingo symbol associated with the first symbol group 88 being removed first, followed by each subsequent bingo symbol 92 of the first set 100.

In one embodiment, as shown in FIG. 9, the gaming controller 32 may conduct a symbol draw operation including selecting the first set 100 and second set 102 of bingo symbols 92 and simultaneously display the first and second sets 100 and 102 in the bingo set display area 96. In addition, the gaming controller 32 may also conduct a subsequent symbol draw operation including selecting a third set and a fourth set of bingo symbols (not shown), and remove the first and second sets 100 and 102 from the bingo set display area 96 before displaying the subsequent third and fourth sets. In another embodiment, the gaming controller 32 may select a plurality of bingo symbol sets 94 during a symbol draw operation and simultaneously display each selected set 94 for a predefined period of time.

In method step 216, the gaming controller 32 determines if each of the selected bingo symbols 92 matches a corresponding player symbol 70 displayed on the bingo card 72, and determines an outcome of the bingo-type game 68 as a function of the matched player symbols 70. In the illustrated embodiment, the player may identify the matched player symbols 70 by transmitting a user selection input via a selection area 78 corresponding to each selected player symbol 70. The gaming controller 32 may compare the selected player symbols 70 displayed on each selected bingo card 72 with each drawn bingo symbol 92, and identify (shown as a "circle" symbol in FIG. 4) each player symbol 70 that matches the drawn game symbol 66.

The gaming controller 32 determines an outcome of the game 68 based on the matched player symbols 70 and provides an award to the player based on the matched player symbols 70, the wager, and a predetermined paytable. For example, the gaming controller 32 may provide an award to the player based on a predefined pattern formed by the matched player symbols 70 on a bingo card 72 and/or a predefined number of matched player symbols 70 on one or more bingo cards 72. Moreover, the gaming controller 32 may also determine a type of game symbol 66 that is matched with a player symbol 70 and provide an award if the matched symbol types are associated with a predefined symbol type. In general, the term "award" may be a payout, in terms of credits or money. Thus, the gaming controller 32 may award a regular payout in response to the outcome of the bingo-type game 68. However, it should be noted that the term award may also refer to other types of awards, including, prizes, e.g., meals, show tickets, etc. . . . , as well as in-game award, such as free games, bonus symbols, and/or special game modes.

In one embodiment, the gaming controller 32 may determine a number of players to be included in a round of the bingo-type game 68 and determine a number of awards that are available during the round based on the number of player's participating in the game round. For example, the gaming controller 32 may determine a predefined number of players required to play a round of the game and/or a predefined number of bingo cards to be included in a game round. The gaming controller 32 may also initiate game play when the number of requests to play the game and/or the number of bingo cards issued is equal to the predefined number of player's and/or the predefined number of bingo cards, respectively. In addition, the gaming controller 32 may also determine a number of awards based on the number of players participating in the game round and/or the number of bingo cards issued during the game round. During play of the game, the gaming controller 32 may determine the outcome of each bingo card 72 and terminate the game round when the determined number of awards has been awarded during the round.

In one embodiment, the gaming controller 32 may also require each player to select the matched player symbols 70 during play of the game and require the player to indicate that the corresponding bingo card 72 includes a winning outcome by selecting a "BINGO!" selection area 130 displayed with each bingo card 72. In another embodiment, during game play, the gaming controller 32 may also determine if a bingo card 72 includes a winning outcome and prompt the player to select the "BINGO!" selection area 130 before providing an award to the player. In this manner, the gaming controller 32 may provide an award to the player only if the player selects the "BINGO!" selection area 130 and the corresponding bingo card 72 includes a winning outcome. In one embodiment, during a round of a game, the gaming controller 32 may determine that the number of players having winning outcomes, for example winning bingo cards, is greater than the number of awards to be provided during the round. The gaming controller 32 may determine which players may receive an award by detecting a number of players who indicate a winning outcome prior to the next symbol draw operation, and provide an award to each player that has indicated a winning outcome before the next symbol set 94 is drawn. In addition, the gaming controller 32 may detect a period of time from the display of the previous drawn set 94 at which each player has indicated a winning outcome prior to the draw of the next symbol set 94, and provide the awards to the players in chronological order based on the time at which each player indicated a wining outcome. The player may indicate a winning outcome by selecting the "BINGO!" selection area 130 upon achieving a winning bingo card outcome.

In addition, in one embodiment, the gaming controller 32 may allow a plurality of players to play the game 68, with each player being assigned one or more bingo cards 72. The gaming controller 32 may randomly select a number of symbol draw operations being conducted during the game 68, and provide an award to the player having the most matched player symbols 70 at the conclusion of the number of symbol draw operations. In another embodiment, the gaming controller 32 may conduct the bingo-type game 68 over a predefined period of time, and provide an award to the player having the highest number of matched player symbols 70 at the end of the time period. In one embodiment, the gaming controller 32 may determine a value of each matched player symbol 70 and provide an award to the player obtaining the highest value matched player symbol 70 and/or the highest total sum of matched player symbols 70. Many variations to the above described general play of a bingo-type game fall within the scope of the present invention.

Figure 11:
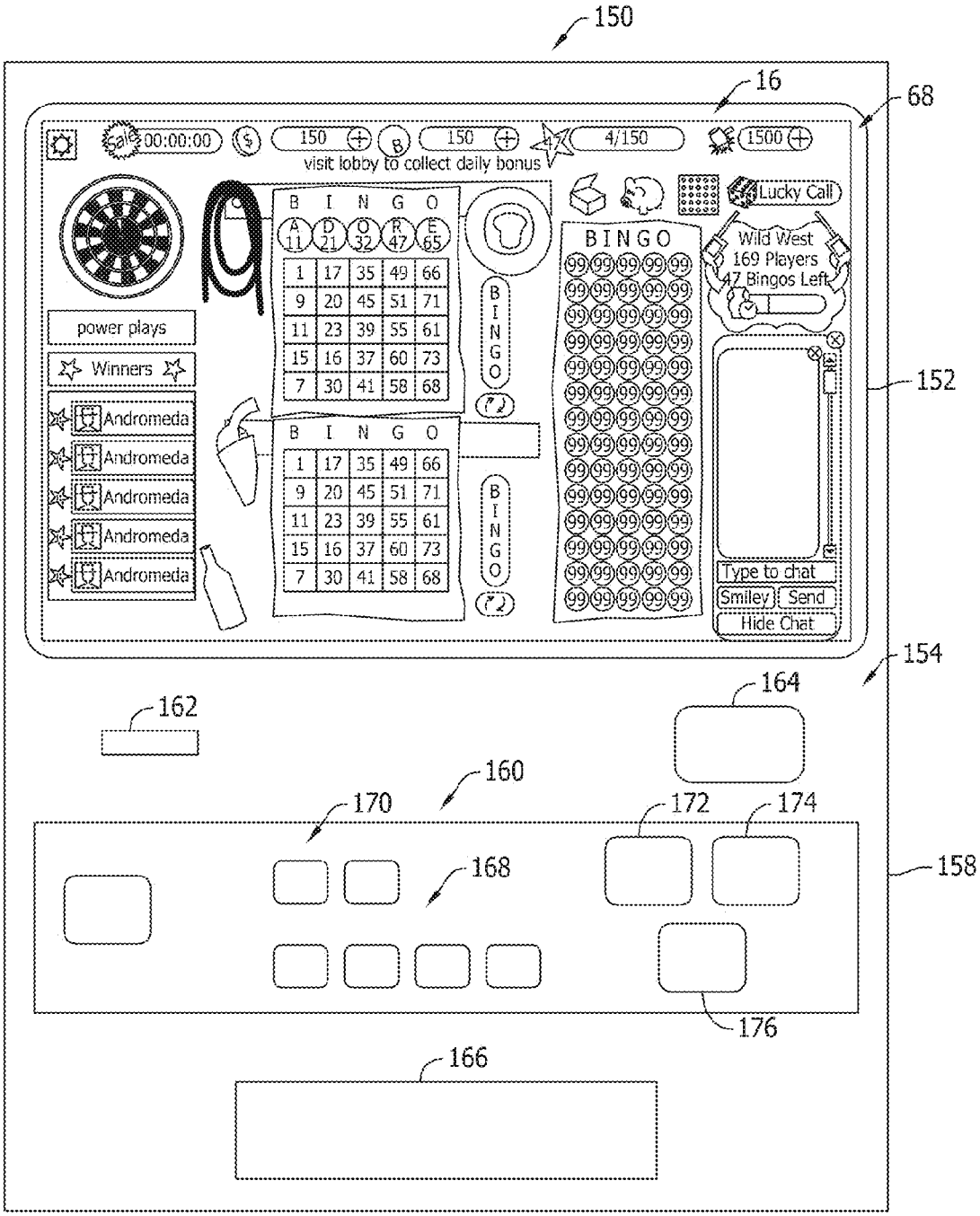
FIG. 11 is a schematic representation of a gaming machine for allowing a player to play a bingo-type game, according to an embodiment of the invention.
Figure 12:
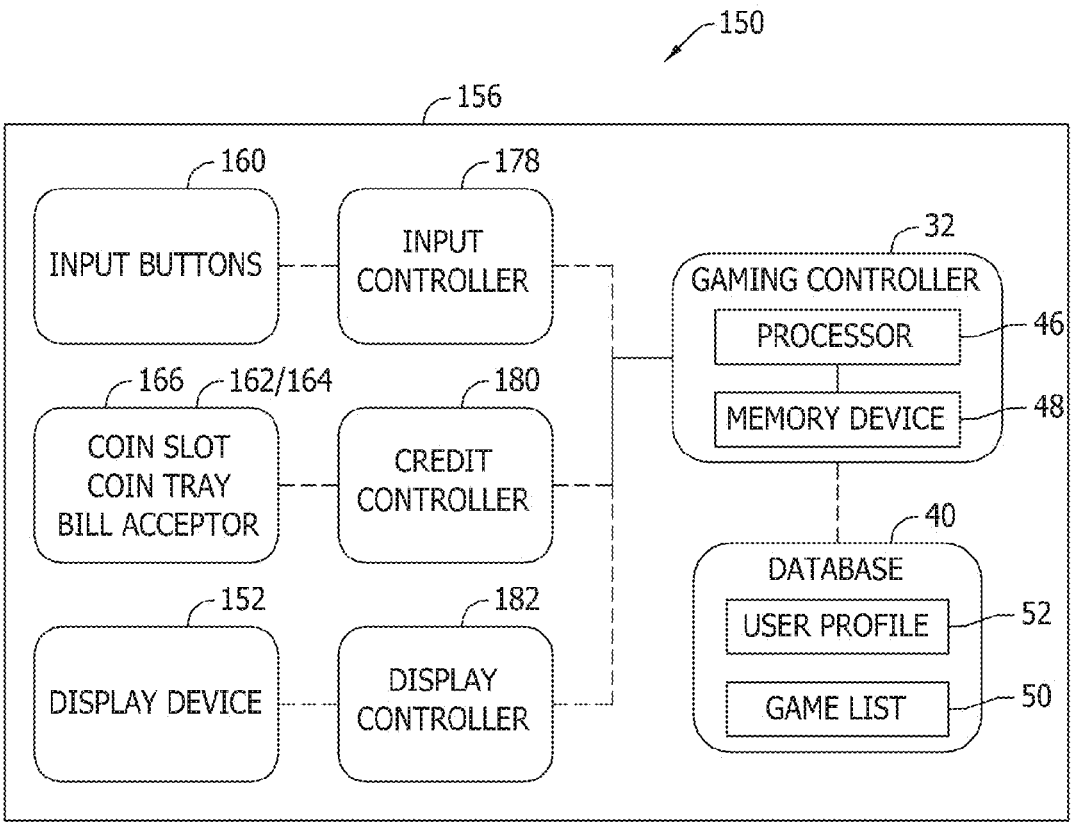
FIG. 12 is another schematic view of the gaming machine shown in FIG. 10.

FIG. 11 is a schematic representation of a gaming machine 150 that may be used with the system 10 to allow a player to play the bingo-type game 68, according to an embodiment of the present invention. FIG. 12 is another schematic view of the gaming machine 150. A preferred embodiment of the present invention is a video gaming machine preferably installed in a casino. In the illustrated embodiment, the gaming machine 150 includes a display device 152 such as, for example a display device 28 for displaying a plurality of games, a user input device 154 to enable a player to interface with the gaming machine 150, and a system controller 156 that is operatively coupled to the display device 152 and the user input device 30 to enable a player to play games displayed on the display device 152. The gaming machine 150 may also include a cabinet assembly 158 that is configured to support the display device 152, the user input device 154, and/or the system controller 156 from a supporting surface.

The display device 152 and the user input device 154 are coupled to the cabinet assembly 158 and are accessible by the player. In one embodiment, the system controller 156 is positioned within the cabinet assembly 158. Alternatively, the system controller 156 may be separated from the cabinet assembly 158, and connected to components of the gaming machine 150 through a network such as, for example, a local area network (LAN), a wide area network (WAN), dial-in-connections, cable modems, wireless modems, and/or special high-speed Integrated Services Digital Network (ISDN) lines.

In the illustrated embodiment, the display device 152 displays the game screen 16 (shown in FIGS. 4-6) including indicia and/or symbols for use in a game, e.g., symbols for a bingo game, cards used by a card game, roulette wheel and symbols used in a roulette game, and/or reels used in a reel game.

The user input device 154 includes a plurality of input buttons 160, a coin slot 162, a bill acceptor 164, and a coin tray 166 for dispensing coins to the player. In one embodiment, the input buttons 160 may include a plurality of BET switches 168 for inputting a wager on a game and selecting a number of rounds to be played during a gaming session, a plurality of selection switches 170 for allowing a player to select a plurality of game symbols, a CLEAR switch 172 for de-selecting player selected game symbols, a PAYOUT switch 174 for ending a gaming session and dispensing accumulated gaming credits to the player, and a start button, i.e., a DRAW switch 176 to initiate an output of a game. In addition, the user input device 154 may include, for example, a keyboard, a pointing device, a mouse, a stylus, a touch sensitive panel (e.g., a touch pad or a touch screen), a gyroscope, an accelerometer, a position detector, an audio input device, and/or any suitable input device that enables the player to interact with the gaming machine 150.

The coin slot 162 includes an opening that is configured to receive coins and/or tokens deposited by the player into the gaming machine 150. The gaming machine 150 converts a value of the coins and/or tokens to a corresponding amount of gaming credits that are used by the player to wager on games played on the gaming machine 150. The bill acceptor 164 includes an input and output device that is configured to accept a bill, a ticket, and/or a cash card into the gaming machine 150 to enable an amount of gaming credits associated with a monetary value of the bills, ticket, and/or cash card to be credited to the gaming machine 150.

Referring to FIG. 12, in the illustrated embodiment, the system controller 156 includes the gaming controller 32, the database 40, an input controller 178, a credit controller 180, and a display controller 182. The gaming controller 32 communicates to the database 40, the input controller 178, the credit controller 180, and the display controller 182, and executes various programs, and thereby controls other components of the gaming machine 150 according to player instructions and data accepted by the user input device 154. The gaming controller 32 in particular executes a game program to implement the method 200 and thereby conducts a game in accordance with the embodiments described herein. In one embodiment, the gaming controller 32 utilizes RAM to temporarily store programs and data necessary for the progress of the game, and EPROM to store, in advance, programs and data for controlling basic operation of the gaming machine 150, such as the booting operation thereof.

The credit controller 180 manages the amount of player's credits, which is equivalent to the amount of coins and bills counted and validated by the bill acceptor 164. The credit controller 180 converts a player's credits to coins, bills, or other monetary data by using the coin tray 166 and/or for use in dispensing a credit voucher via the bill acceptor 164.

The input controller 178 is coupled to the user input device 154 to monitor player selections received through the input buttons 160, and accept various instructions and data that a player enters through the input buttons 160.

The display controller 182 controls the display device 152 to display various images on screens preferably by using computer graphics and image data stored in the database 40. More specifically, the display module 54 controls the game symbols displayed in the game such as, for example, a bingo-type game 68 displayed on the display device 152 by using computer graphics and the image data.

Figure 13:
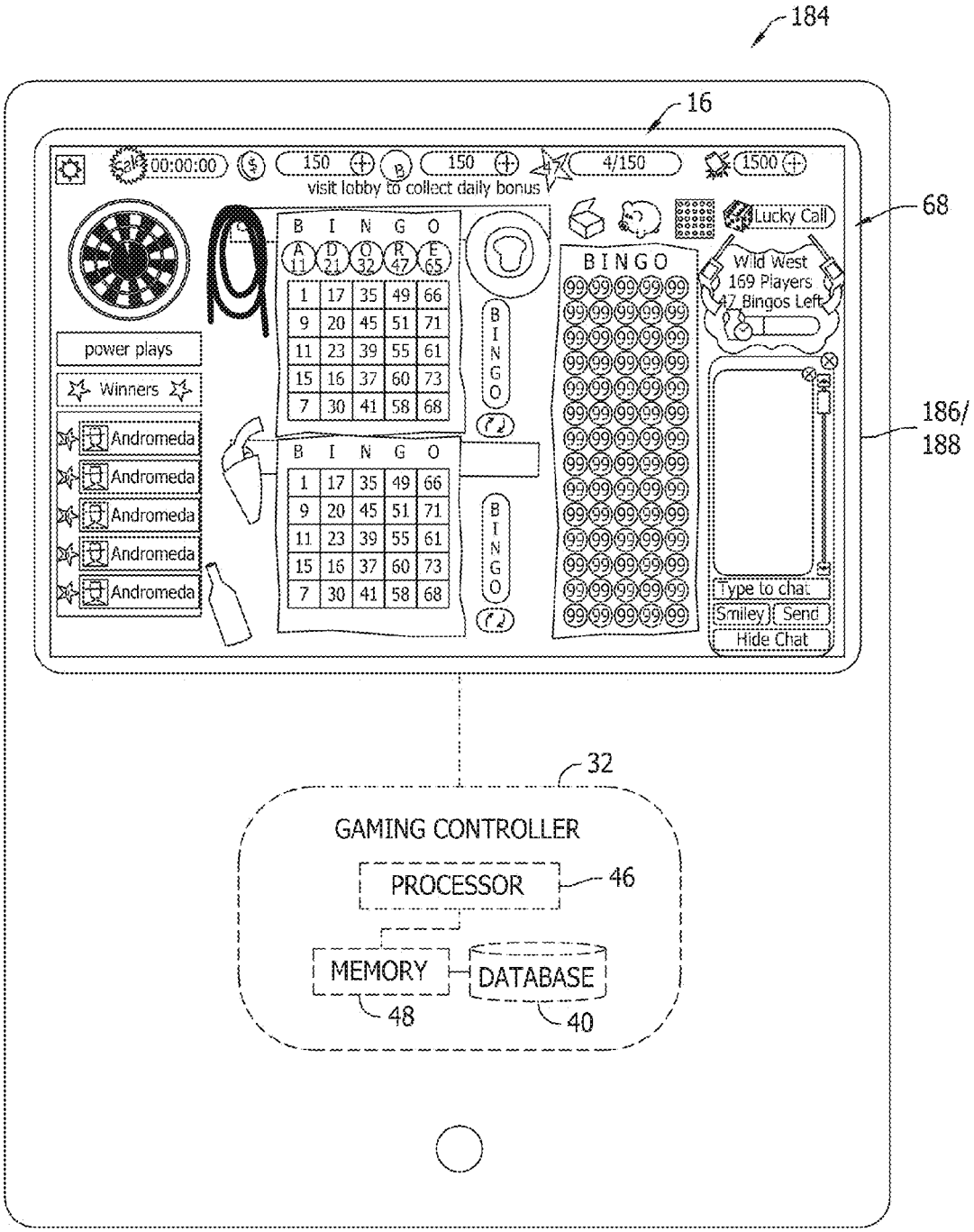
FIG. 13 is a schematic view of a gaming device for allowing a player to play a bingo-type game, according to an embodiment of the invention.

FIG. 13 is a schematic view of a gaming device 184 for allowing a player to play the bingo-type game 68, according to an embodiment of the invention. The gaming device 184 may be a smartphone, a personal computer, laptop, cell phone, tablet computer, smartphone/tablet computer hybrid, personal data assistant, smart watch, and/or any suitable computing device that displays the graphical interfaces 16 and enables the user to play the bingo-type game 68. In the illustrated embodiment, the gaming device 184 includes a display device 186 such as, for example, display device 28, a user input device 188 such as, for example, user input device 30, and the gaming controller 32 coupled to the display device 186 and the user input device 188.

The gaming controller 32 includes the database 40, the processor 46, and the memory device 48 that is coupled to the processor 46. The memory device 48 stores programs and information used by the processor 46 including, but not limited to, image data for producing images and/or screens on the display device 186, game indicia, symbol weights, paytables, and/or winning combination tables which represent relationships between combinations of random numbers, combinations of symbol matches and types of awards associated with the bingo-type game 68.

The processor 46 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the gaming controller 32 to store, retrieve, and/or execute instructions and/or data. The gaming controller 32 in particular executes a game program to implement the method 200 and thereby conducts a game in accordance with the embodiments described herein.

The above-described systems and methods overcome at least some disadvantages of known systems by allowing a player to play a bingo-type game that selects a set of game symbols including a game symbol from each of a plurality of symbol groups, and simultaneously displays each game symbol in the selected set for a limited period of time to enable the player to match the displayed game symbols with the bingo symbols. By simultaneously displaying each game symbol in the selected set of game symbols for a limited period of time and by providing awards based on the order in which the players indicate a winning combination the excitement and interest of the players is increased because each player only has a limited amount of time to view a set of selected game symbols, thus increasing the amount of bingo cards purchased by the player and increasing the amount of revenue received from the purchases.

Exemplary embodiments of a system and method of allowing a player to play a bingo-type game via a mobile computing device are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other wagering applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A machine-implemented method of implementing a bingo-type game, comprising:

determining a value of a physical object received via a slot, and crediting the value of the physical object to an account of a user;

receiving from the user an indication of a wager amount for playing the bingo-type game;

accessing a computer data repository that defines a plurality of symbol groups;

randomly selecting, for the bingo-type game, a respective bingo symbol from each of the plurality of symbol groups;

determining a plurality of sets of player symbols, each set of player symbols corresponding to a different respective one of the symbol groups;

generating a user interface that displays a grid having multiple columns and rows, each column populated with a different respective one of the sets of player symbols such that each column corresponds to a different respective symbol group;

while the user interface displays the grid populated with the sets of player symbols, sequentially exposing, and then sequentially removing from display, the selected bingo symbols, such that the user is given a limited time in which to identify and indicate matches between the bingo symbols and the player symbols;

determining an outcome of the bingo-type game as a function of the user-indicated matches between the player symbols and bingo symbols; and updating the account of the user based at least partly on the determined outcome and the wager amount;

said method performed in its entirety by a computing system that comprises one or more computing devices.

2. The method of claim 1, wherein the plurality of symbol groups consists of five symbol groups.

3. The method of claim 1, wherein each symbol group consists of a different respective range of numbers, wherein the ranges of numbers do not overlap with each other and each range of numbers consists of a contiguous range of whole numbers.

4. The method of claim 1, wherein the method comprises selecting two bingo symbols from each symbol group, and, for each symbol group, displaying the two selected bingo symbols in correspondence with the column corresponding to the symbol group.

5. A gaming machine, comprising:

a currency acceptor comprising a slot for receiving a physical object representing a value, the currency acceptor configured to determine a value of the physical object and to credit the value to an account of a user; and a computing system programmed to implement a bingo-type game according to a process that comprises:

receiving from the user an indication of a wager amount for playing the bingo-type game;

selecting a respective bingo symbol from each of a plurality of symbol groups;

determining a plurality of sets of player symbols, each set of player symbols corresponding to a different respective one of the symbol groups;

generating a user interface that displays a grid having multiple columns and rows, each column populated with a different respective one of the sets of player symbols such that each column corresponds to a different respective symbol group;

while the user interface displays the grid populated with the sets of player symbols, sequentially exposing, and then sequentially removing from display, the selected bingo symbols;

providing a limited time period for the user to indicate, via the user interface, matches between the bingo symbols and the player symbols;

determining an outcome of the bingo-type game as a function of the user-indicated matches between the player symbols and bingo symbols; and updating the account of the user based at least partly on the determined outcome and the wager amount.

6. The gaming machine of claim 5, wherein the user interface provides an option for the user to indicate that a bingo condition exists, and wherein the process further comprises determining a payout amount that is dependent upon a timing with which the user indicates that the bingo condition exists relative to other users participating in the bingo-type game.

* * * * *